US008853955B2

(12) United States Patent
Gray et al.

(10) Patent No.: US 8,853,955 B2
(45) Date of Patent: Oct. 7, 2014

(54) DEVICE AND METHOD FOR USING HIGH EFFICIENCY BALLASTED LAMPS WITH ELECTRONIC TRANSFORMER

(75) Inventors: Richard Landry Gray, Saratoga, CA (US); Po Ming Tsai, Taipei (TW)

(73) Assignee: Richard Landry Gray, Saratoga, CA (US)

( * ) Notice: Subject to any disclaimer, the term of this patent is extended or adjusted under 35 U.S.C. 154(b) by 84 days.

(21) Appl. No.: 13/590,245

(22) Filed: Aug. 21, 2012

(65) Prior Publication Data

US 2013/0049619 A1 Feb. 28, 2013

Related U.S. Application Data

(60) Provisional application No. 61/526,253, filed on Aug. 22, 2011.

(51) Int. Cl.

| | |
|---|---|
| ***H05B 37/02*** | (2006.01) |
| ***H05B 41/36*** | (2006.01) |
| ***H05B 33/08*** | (2006.01) |
| ***H05B 41/282*** | (2006.01) |

(52) U.S. Cl.

CPC ..... *H05B 33/0815* (2013.01); *H05B 41/2827* (2013.01); *H05B 41/2828* (2013.01)

USPC ..... 315/201; 315/185 R; 315/276

(58) Field of Classification Search

USPC ..... 315/201, 205, 185 R, 276, 291, 312, 315/307, 326

See application file for complete search history.

(56) References Cited

U.S. PATENT DOCUMENTS

| | | | | |
|---|---|---|---|---|
| 4,042,856 | A * | 8/1977 | Steigerwald | 315/246 |
| 7,944,156 | B2 * | 5/2011 | Quazi | 315/307 |
| 2009/0230870 | A1 * | 9/2009 | Quazi | 315/85 |

* cited by examiner

*Primary Examiner* — Daniel D Chang

(57) ABSTRACT

An approach is provided for devices and methods for using high efficiency ballasted lamps with an electronic transformer, especially for the replacement of traditional halogen lamps from the existing fixtures. The method comprises acts of synchronizing a reference signal to a voltage corresponding to an AC voltage from an AC power source, and driving a load at a predetermined duty cycle. Therefore, the present disclosure is able to drive a load with a desired average output power lower than the minimum load requirement of the electronic transformer yet still allow the electronic transformer to work properly.

11 Claims, 5 Drawing Sheets

Fig. 1 --Prior Art--

DEVICE AND METHOD FOR USING HIGH EFFICIENCY BALLASTED LAMPS WITH ELECTRONIC TRANSFORMER

This application claims priority benefit under 35 USC 119 of provisional patent application Ser. No. 61/526,253, filed 22 Aug. 2011.

FIELD OF THE INVENTION

Embodiments of the present disclosure relate to devices and methods of driving high efficiency ballasted lamps (i.e., white light emitting diodes (WLEDs) or cold cathode fluorescent lamps (CCFLs), and especially toward devices and methods for using high efficiency ballasted lamps with an electronic transformer.

BACKGROUND

Low voltage halogen lamps have been a popular replacement for incandescent lamps especially for decorative applications. They are more efficient than traditional incandescent lamps but not as efficient as the modern generation of lighting such as white light emitting diodes (WLEDs) or cold cathode fluorescent lamps (CCFLs). Halogen lamps run very hot and must be placed an appropriate distance away from any combustible materials. They also need a low voltage AC (or DC) supply (i.e., usually between 12 and 24 volts). Traditionally, a low voltage supply for halogen lamps was supplied from the AC source by a step-down transformer. These transformers, since they are designed for 50-60 Hz, must necessarily be made large and heavy. Although they are simple and reliable, they require a large amount of raw materials, especially copper and iron.

With reference to FIG. 1, this figure illustrates a traditional electronic transformer for a halogen lamp. In order to save on raw materials and cost, a common technique has been to replace the 50-60 Hz transformer with what is known as an electronic transformer or e-transformer. The electronic transformer uses a self oscillating resonant circuit to produce an AC signal at 20-40 k Hz. At those higher frequencies a step-down transformer can be made many times smaller than a traditional transformer that runs at 50-60 Hz. The size and overall cost of the electronic transformer is much less than a traditional 50-60 Hz transformer.

The world's desperate need to conserve energy obligates the engineering community to look for low cost methods to retrofit halogen lights using e-transformers with high efficiency alternatives. For example, replacing the halogen lamp should be no more difficult than removing the old halogen bulb and replacing it with a bulb using suitable WLEDs. Due to the realization that halogen lamps are not particularly efficient there has been a trend to replace those halogen lamps with equivalently sized WLED lamps. A 50 W halogen lamp could ideally be replaced by a 10 W (or less) WLED lamp capable of producing the same amount of illumination. The potential power savings is enormous.

However, the problem with the WLED replacement strategy is that the electronic transformers that are used for halogen light fixtures require a minimum load larger than 10 Watts for proper operation. Since most WLED loads are smaller than 10 W these electronic transformers do not operate properly with WLED lamps. Compounding this problem is the situation that in some countries the e-transformer may be placed behind a wall or some locations that are not easily accessible by the consumer. Therefore, this problem will increase the cost of using high efficiency lighting beyond what many consumers would be willing to pay.

Therefore, there is a need for an approach to provide a device or means to allow an electronic transformer to be able to drive highly efficient lamps in a low power level condition, allowing the replacement of old halogen lamps from the existing fixtures with other high efficiency lamps.

Some Exemplary Embodiments

These and other needs are addressed by the present disclosure, wherein an approach is provided for devices and methods for using high efficiency ballasted lamps with electronic transformers that are able to drive a lamp with a desired average output power lower than the minimum load requirement of the electronic transformer yet still make the electronic transformer operate properly.

Another approach is provided for devices and methods for using high efficiency ballasted lamps that are able to replace the old halogen lamps from the existing fixtures.

According to one aspect of an embodiment of the present disclosure, a method comprises acts of synchronizing a reference signal to a voltage corresponding to an AC voltage from an AC power source, and driving a load at a predetermined duty cycle operation.

The relation for the predetermined duty cycle can be defined as follows:

$$\text{The duty cycle } (\%) = \frac{1}{N} \times 100\%;$$

wherein

N×(the desired average output power)>the minimum load requirement of the electronic transformer, N is real positive number.

According to one aspect of an embodiment of the present disclosure, a device comprises a driver, a load, a bridge and a controller. The load is connected to the driver. The bridge has a rectifying bridge and a two rectifying diodes. The rectifying bridge is configured for providing a rectified power to the driver that drives the load. The two rectifying diodes are respectively connected to two output ends of an electronic transformer, and are configured for producing a resultant signal that is rectified from the output of the electronic transformer. The controller is connected between the two rectifying diodes and the driver, and receives the resultant signal to generate a control signal that enables the load through the driver for a duty cycle.

Accordingly, the present disclosure is able to provide a load made from a high efficiency ballasted lamp with a desired average output power lower than the minimum load requirement of the electronic transformer yet that still allows for proper operation of the electronic transformer.

BRIEF DESCRIPTION OF THE DRAWINGS

The disclosure is illustrated by way of example, and not by way of limitation, in the figures of the accompanying drawings in which like reference numerals refer to similar elements and in which.

DESCRIPTION OF THE PREFERRED EMBODIMENT

Embodiments of the apparatus and/or methods are disclosed. In the following description, for purposes of explanation, numerous specific details are set forth in order to provide a thorough understanding of the embodiments of the disclosure. It is apparent, however, to one skilled in the art that the present disclosure may be practiced without these specific details or with an equivalent arrangement.

Figure 1:
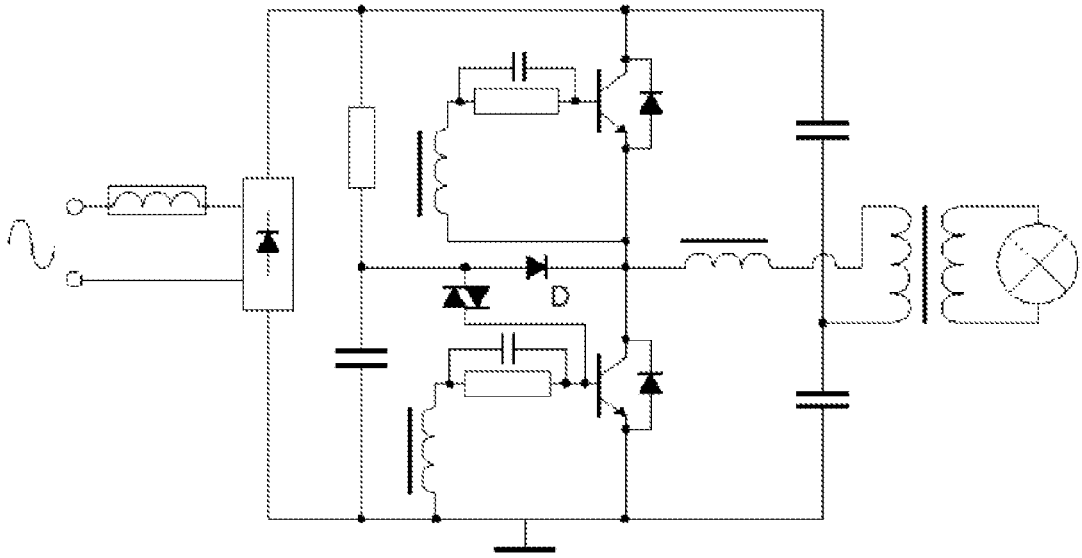
FIG. 1 is a schematic view of a conventional electronic transformer for a halogen lamp.
Figure 2:
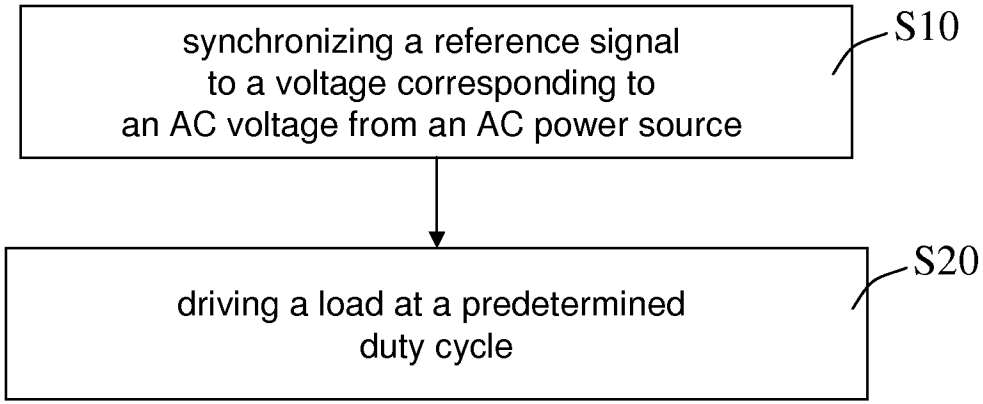
FIG. 2 is an exemplary flowchart of a method for using high efficiency ballasted lamps with an electronic transformer in accordance with the present disclosure.
Figure 3:
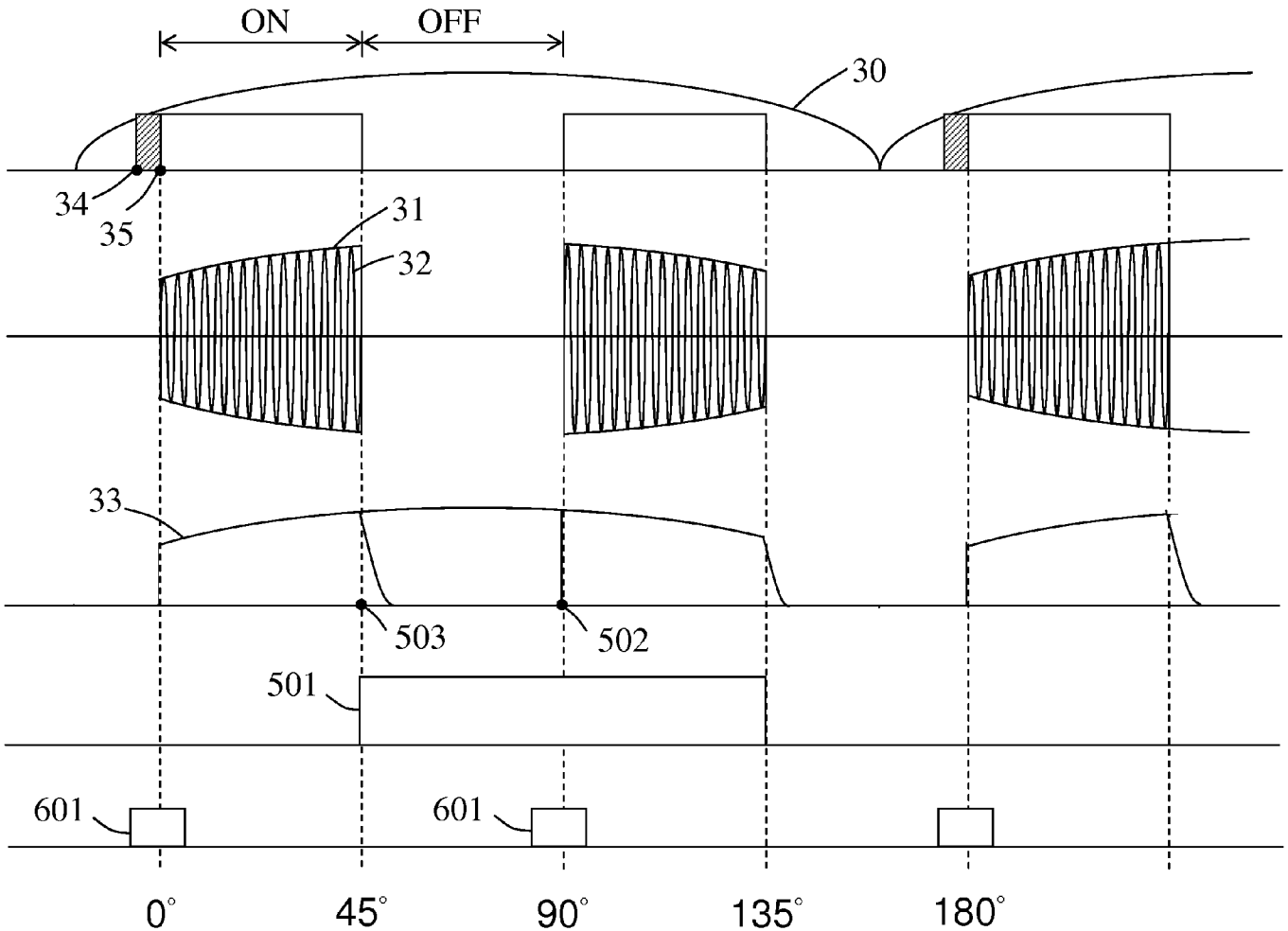
FIG. 3 is an exemplary waveform diagram indicating the AC voltage, output voltage of the electronic transformer and the synchronized reference signal in accordance with the present disclosure.

With reference to FIGS. 2 and 3, FIG. 2 is a flowchart of a method for using high efficiency ballasted lamps with an electronic transformer in accordance with the present disclosure. In this embodiment, the high efficiency ballasted lamps will be referred to as WLED lighting. The term, WLED lighting, will be used for the rest of this disclosure although other lamp technologies such as CCFL (cold cathode fluorescent lamps) could also be used.

As shown in FIG. 2, the method for using a high efficiency ballasted lamp with an electronic transformer comprises steps of S10 synchronizing a reference signal to a voltage corresponding to an AC voltage from an AC power source, and S20 driving a load at a predetermined duty cycle.

The predetermined duty cycle is preset according to the relation of the minimum load requirement of the electronic transformer and the output power of the lamp (i.e. WLED). For example, imagine the minimum load requirement of the electronic transformer is 10 W and the output power of the WLED is 9 W. In general, the 9 W WLED does not provide enough of a load to maintain proper operation of the electronic transformer. In this example, the method in accordance with the present disclosure may make the electronic transformer drive the WLED at 18 W at a 50% duty cycle. The desired average output power will still only be 9 W yet when the WLED is on it provides an 18 W power load to the electronic transformer, which allows the electronic transformer with a minimum load requirement of 10 W to work properly. Therefore, instead of a continuous 9 W optical output, the present disclosure drives the WLED lamp at 18 W for 50% of the time.

Accordingly, the relation for the predetermined duty cycle can be defined as follows:

$$\text{The duty cycle } (\%) = \frac{1}{N} \times 100\%;$$

and

N×(the desired average output power)>the minimum load requirement, N is a positive real number.

In another example, suppose that the desired power output of the load is 3.5 W and the minimum load requirement of the electronic transformer is 15 W. Accordingly N is selected to be 5 in order to increase the operative power output of the e-transformer to 17.5 W, which is larger than the minimum load requirement of the electronic transformer. The operational duty cycle is 20%. Therefore, in this example, the lamp provides a 17.5 W load for the electronic transformer while maintaining an average 3.5 W output.

It is not necessary to increase the power dissipation capability of the WLED lamp even though they will be run at approximately 2 times (or more) the current that was originally intended. The limiting factor for many WLEDs is not current but rather the maximum heat that can be dissipated by the diodes. WLEDs are essentially point sources of light and heat, and thus they are notoriously bad at dissipating their own power, which is one of the major things that limits their lifetime, especially in poorly designed lamps. Since the WLEDs in use for the present disclosure are only on for a percentage of the time (e.g. 20% or 50%), the total power dissipation for the WLEDs is the same as in the continuous conduction where the driving current of the WLED is 20% and 50% as the examples described above.

In addition to the preceding issues, the ON and OFF frequency of the WLED lamp should be larger than 200 Hz in order to avoid deleterious health effects.

The frequency beating phenomenon means that the difference in output frequencies among different lamps may become noticeable to the lamp user, especially if the difference in frequency is small, on the order of several Hz. Although two different lamps are designed using the same structure or IC controller (i.e. using same frequency as an operating frequency), they will still has some difference in operating frequency due to process or operating variations. For example, if one lamp's frequency of operation is 200 Hz, and another s lamp runs at 203 Hz, then the difference in frequency would be 3 Hz. This difference would produce a visible flicker at 3 Hz (<120 Hz) which may make the lamp user feel uncomfortable. Many studies on this subject recommend a minimum lamp flicker frequency of 170 Hz or higher. The frequency beating phenomenon gets worse when a plurality of lamps is placed in a same viewing area. Accordingly, the step S10 that synchronizes a reference signal to a voltage corresponding to the AC voltage from the AC power source, allows all devices using this method of the present disclosure to use the same reference frequency, and thus the frequency beating phenomenon among lamps can be resolved. Step S10 can be implemented using a phase-locked loop (PLL) that synchronizes the operation of the invention to a frequency that corresponds to the AC voltage.

It would be ideal if the invention had direct access to the signal from AC power source in order to synchronize the lamp output to the AC voltage. Unfortunately, in most cases of WLED replacements for halogen lamps using the electronic transformers, direct access to the AC power source is prohibited and/or expensive. It is commercially desirable to use the output of the electronic transformer to synchronize lamp operation. However, the frequency of the output voltage from the electronic transformer is 20-40 kHz or higher, which is substantially different from the 50 or 60 Hz available from the AC mains.

Figure 4B:
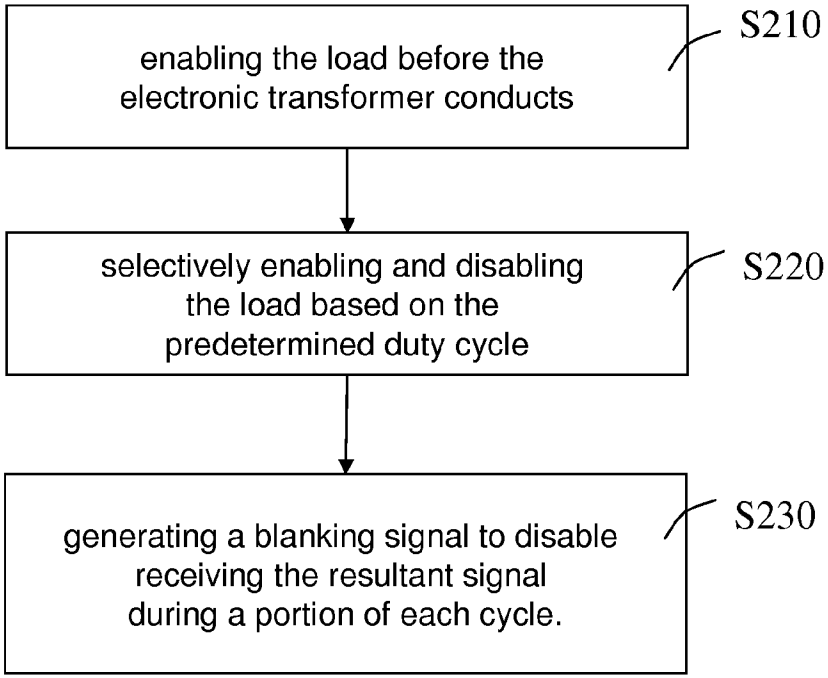
FIG. 4B is an exemplary flowchart of S20 in FIG. 2 in accordance with an embodiment of the present disclosure.
Figure 4A:
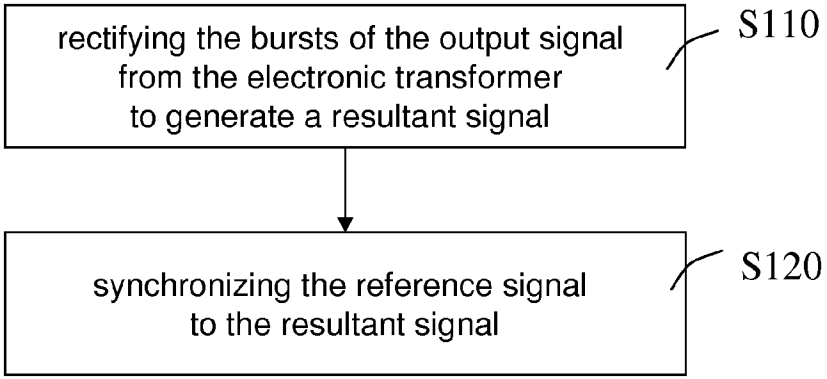
FIG. 4A is an exemplary flowchart of S10 in FIG. 2 in accordance with an embodiment of the present disclosure.

With reference to FIGS. 2, 3 and 4A, FIG. 3 is diagram of waveforms indicating the AC voltage, the output voltage of the electronic transformer and the synchronized reference signal in accordance with the present disclosure. As shown in FIGS. 3 and 4A, the frequency of the output from the electronic transformer is in bursts 32 corresponding to the AC voltage 30. The step S10 further comprises acts of S110 rectifying the bursts 32 of the output signal from the electronic transformer to generate a resultant signal 31, and S120 synchronizing the reference signal 33 to the resultant signal 31. Signal 33 is derived from signal 31, as will be described later, and is used as the time base reference for the generation of all the succeeding control signals. Since time base reference signal 33 is derived from the resultant signal 31 which is derived from the rectified output signal of the electronic transformer which is in turn derived from the AC voltage, then time base reference signal 33 is synchronized to the AC voltage 30 in an indirect manner.

Figure 5:
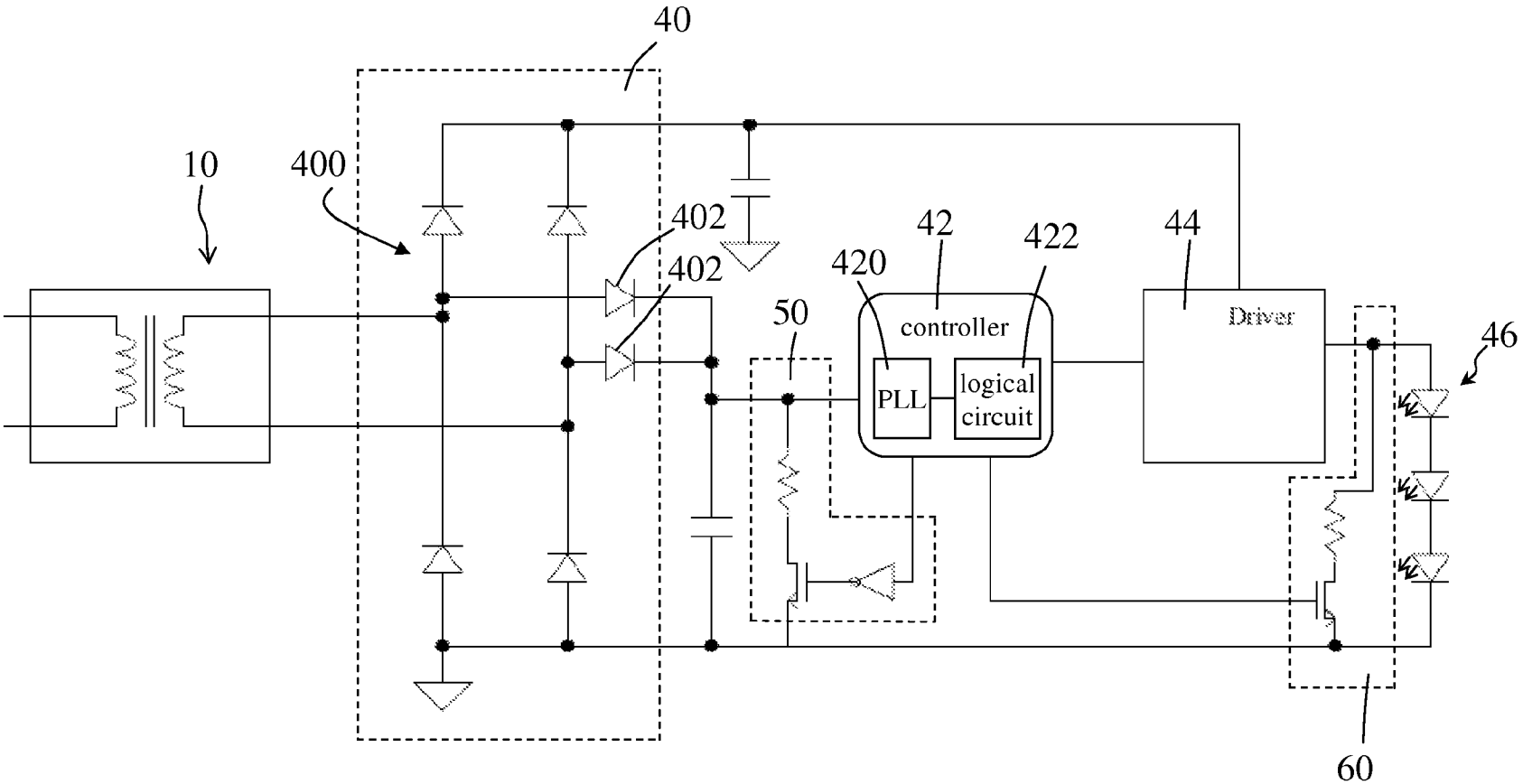
FIG. 5 is an exemplary diagram of a device for using high efficiency ballasted lamps with an electronic transformer in accordance with an embodiment of the present disclosure.

FIG. 5 illustrates a circuit diagram that employs the method described in accordance with the present disclosure. In this embodiment, the device for using high efficiency ballasted lamps with an electronic transformer is connected to the output (i.e. secondary side) of the electronic transformer 10. The device comprises a bridge 40, a controller 42, a driver 44 and a load 46. In this example, the load is a WLED string. The bridge 40 comprises a rectifying bridge 400 and a two rectifying diodes 402. The rectifying bridge 40 is configured for providing a rectified power to the driver 44 that drives the WLED string 46. The two rectifying diodes 402 are connected respectively to the two output ends of the electronic transformer 10, and are configured for producing the resultant signal that is rectified from the output signal of the electronic transformer 10.

The controller 42 is connected between the cathodes of the two rectifying diodes 402 and the driver 44, and receives the resultant signal to generate a control signal that enables the load 46 through the driver 44 for the predetermined duty cycle (Step S20). In this embodiment, the controller 42 may comprise a phase-locked loop (PLL) unit 420 and a logical circuit 422 (e.g. a digital division). The PLL unit 420 synchronizes to time base reference signal 33, and the logical circuit provides higher synchronized frequencies in the PLL feedback loop. A person skilled in art is able to practice this without specific circuit arrangement details.

Once the PLL unit 420 has established a phase lock, the controller 42 then instructs the driver 44 to turn ON the load 46 at the appropriate time for a predetermined duty cycle (Step S20 shown in FIG. 2). Each time the load is ON at a level high enough so that the electronic transformer 10 operates properly. As shown in FIG. 3, during the OFF portion of the load 46, the electronic transformer 10 does not transfer power to the load 46.

The controller 42 may send out the control signal to enable the load 46 (through the driver 44) at a time (see signal 34 shown in FIG. 3) before the AC voltage is high enough to enable the electronic transformer 10 (see signal 35 shown in FIG. 3). In this manner, the load 46 can be sure to be present once the electronic transformer 10 starts to operate. Furthermore, the controller 42 may generate a blanking signal that causes the PLL unit 420 to ignore the resultant signal from the two rectifying diodes 420 at particular times. Therefore, the PLL unit 420 is able to ignore the extra synchronization edges (see signal edge 502 shown in FIG. 3) when the load is turned ON again after the initial turn ON at the start of each burst from the electronic transformer 10. The PLL unit 420 should only synchronize to phase information that derives from the incoming AC voltage to the electronic transformer 10, not to the phase information produced by the PLL unit 420 itself. If it did, then it would find itself synchronizing itself to a signal that is produced by itself, clearly an unwanted situation.

In the embodiment shown in FIGS. 3 and 5, the device further comprises a blanking module 50. The blanking module 50 allows PLL unit 420 to ignore the synchronization signal derived from resultant signal 31 for a period of time after the initial ON time at the beginning of each cycle. For example, the waveform of the blanking signal 501 shown in FIG. 3 indicates that the blanking signal 501 will keep the voltage of signal 33 high and prevent a low to high transition of signal 33 at time point 502 of FIG. 3. Without this feature signal 33 would decay at time point 503 then rise again at time point 502 causing the PLL unit 420 to synchronize to the wrong signal. In this example, the blanking signal 501 is enabled from 45° to 135°. The low to high transition of signal 33 at 90° (time point 502) of the resultant signal 31 from the rectifying diodes 402 does not occur so the PLL unit 420 will operate as intended. The example shown in FIG. 3 indicates 50% duty cycle.

In FIG. 4B, step 20 further comprises acts of S210 enabling the load before the electronic transformer conducts, S220 selectively enabling and disabling the load based on the predetermined duty cycle, and S230 generating a blanking signal to disable receiving the resultant signal during a portion of each cycle.

It is noted that synchronization is important to the present disclosure. Synchronization provides time information to the controller 42 to turn the load 460N and OFF at exact and specific times with relation to the incoming AC voltage. If the control signal of the controller 42 is not synchronized to the resultant signal, which corresponds to the AC voltage, the ON time of the load 46 might occur at wholly inappropriate times, such as when the AC voltage is near zero volts and the electronic transformer would have no opportunity to conduct.

A potential problem exists during startup in that in order to obtain the synchronized reference signal that the PLL needs to establish proper timing the electronic transformer needs to conduct, but without the proper enable signal to the WLED lamp, the electronic transformer will not operate properly, which will in turn not provide a synchronized reference signal before the phase lock. Some intervention is needed otherwise the electronic transformer 10 may never turn on properly.

As shown in FIGS. 3 and 5, the device further comprises dummy load module 60. The dummy load module 60 is connected between the controller 42 and the load 46, and comprises a transistor 600 and a dummy load 602. The source of the transistor 600 is connected to ground, the drain of the transistor 600 is connected to the load 46 and the gate of the transistor 600 is connected to the controller 42. The controller 42 sends a dummy load signal 601 to switch the dummy load 6020N for a period of the time during the start up of the PLL unit 420 for establishing the phase lock.

The dummy load 602 illustrated in the FIG. 5 is a resistor, however, it also can be an infra-red (IR) light emitting diodes or another set of WLED diodes. It would be ideal if the dummy load would be able to dissipate some of the start up power by radiating it away from the lamp. The benefit of using IR diodes instead the WLED diodes is that the IR diodes would radiate energy away from the lamp without temporarily noticeably increasing the light output during start up.

Since there are many different variations of electronic transformer there may arise a situation where a particular electronic transformer will not start properly again after the load 46 has been turned off in the middle of a cycle. As further shown in FIG. 3, the dummy load may continue to be applied at specific times during steady state operation as well as during start up, in order to allow the electronic transformer 10 to start quickly and provide a definite timing signal. Therefore, the dummy load may be applied for the times during the middle of the cycle that the load 46 is off. This will, of course, not be as efficient as the case when the dummy load is used more sparingly. However, the overall efficiency of the dummy load coupled with the WLED load 46 will still be more energy efficient than any halogen lamp with equivalent light output.

While the invention has been described in connection with a number of embodiments and implementations, the invention is not so limited but covers various obvious modifications and equivalent arrangements, which fall within the purview of the appended claims. Although features of the invention are expressed in certain combinations among the claims, it is contemplated that these features can be arranged in any combination and order.

What is claimed is:

1. A method for using a high efficiency ballasted lamp with an electronic transformer, comprising:

synchronizing a reference signal to a voltage corresponding to an AC voltage from an AC power source; and driving a load at a predetermined duty cycle, wherein the predetermined duty cycle is preset according to the relation of the minimum load requirement of the electronic transformer and the output power of the lamp.

2. The method as claimed in claim 1, wherein the predetermined duty cycle has a following relation:

$$\text{The percentage of the duty cycle } (\%) = \frac{1}{N} \times 100\%;$$

and

N×(a desired average output power)>a minimum load requirement, N is positive real number.

3. The method as claimed in claim 1, wherein the acts of synchronizing a reference signal to a voltage corresponding to an AC voltage from an AC power source, further comprises:

rectifying the bursts of the output signal from the electronic transformer to generate a resultant signal; and synchronizing the reference signal to the resultant signal.

4. The method as claimed in claim 3, wherein the acts of driving a load at a predetermined duty cycle, further comprises:

enabling the load before the electronic transformer is conducted; and selectively enabling and disabling the load based on the predetermined duty cycle.

5. The method as claimed in claim 4, wherein the acts of driving a load at a predetermined duty cycle, further comprises:

generating a blanking signal to disable receiving the resultant signal.

6. A device for using a high efficiency ballasted lamp with an electronic transformer, comprising:

a driver;

a load being connected to the driver;

a bridge comprising:

a rectifying bridge being configured for providing a rectified power to the driver that drives the load; and a two rectifying diodes being respectively connected to two output ends of the electronic transformer, and being configured for producing a resultant signal that is rectified from the output of the electronic transformer; and a controller being connected between the rectifying diodes and the driver, and receiving the resultant signal to generate a control signal that enables the load through the driver for a predetermined duty cycle.

7. The device as claimed in claim 6, wherein the controller is implemented using a phase-locked loop unit and a logical circuit.

8. The device as claimed in claim 6, further comprising:

a blanking module being configured for disabling the resultant signal to the controller, and being connected between the controller and the two rectifying diodes.

9. The device as claimed in claim 6, further comprising:

a dummy load module being connected between the controller and the load, and being configured to turn a dummy load ON for a period before the control signal is phase locked to the resultant signal.

10. The device as claimed in claim 9 where the dummy load is turned ON for periods during the cycle to enhance the electronic transformer start up after the load has been turned off for the predetermined period.

11. The device as claimed in claim 6, wherein the load is white light emitting diode or cold cathode fluorescent lamps.

* * * * *